United States Patent [19]

Craig

[11] 4,082,015

[45] Apr. 4, 1978

[54] REMOVABLE DRILL BIT NOZZLE

[75] Inventor: Paul George Craig, Dallas, Tex.

[73] Assignee: Dresser Industries, Inc., Dallas, Tex.

[21] Appl. No.: 762,687

[22] Filed: Jan. 26, 1977

Related U.S. Application Data

[62] Division of Ser. No. 654,148, Jan. 30, 1976, Pat. No. 4,019,593.

[51] Int. Cl.[2] ..... B21K 5/02

[52] U.S. Cl. ..... 76/108 A

[58] Field of Search ..... 76/108 R, 108 A

[56] References Cited

U.S. PATENT DOCUMENTS

| | | | |
|---|---|---|---|
| 2,597,482 | 5/1952 | Harrison et al. | 285/305 |
| 3,084,751 | 4/1963 | Scarborough | 175/340 |
| 3,115,200 | 12/1963 | Mandrell | 175/340 |
| 3,220,754 | 11/1965 | Takeshi | 175/340 |
| 3,329,222 | 7/1967 | Neilson | 175/340 |

*Primary Examiner*—Harold D. Whitehead
*Assistant Examiner*—Roscoe V. Parker
*Attorney, Agent, or Firm*—Eddie E. Scott

[57] ABSTRACT

A nozzle is releasably locked in a drilling fluid passage of a rotary rock bit by a retainer member which bridges between matching grooves in the periphery of the nozzle and in the wall of the passage respectively. The retainer member is introduced to the matching grooves through a first passageway that extends from the surface of the bit to the matching grooves. The grooves lie in a common plane. A second passageway extends at an angle to the common plane from the surface of the bit to the matching grooves. A drive-out tool is inserted through the second passageway to remove the retainer member.

1 Claim, 4 Drawing Figures

REMOVABLE DRILL BIT NOZZLE

This is a division, of application Ser. No. 654,148, filed Jan. 30, 1976 now U.S. Pat. No. 4,019,593.

BACKGROUND OF THE INVENTION

The present invention relates to the art of earth boring and more particularly to a removable nozzle for bits that use a drilling fluid which is jetted downwardly toward the cutting operation carried on by the cutters against the bottom of the hole. More particularly, the invention relates to the provision of a fluid nozzle for the drilling fluid which may be easily installed, or replaced by a nozzle of different size or internal contour.

The bit to which the invention relates may be of any conventional form wherein the drilling fluid is pumped to the bit for direction by a nozzle downwardly from the bit. It is customary to provide a nozzle structure which is of different material than that used for the body of the bit itself. The nozzle is usually of material which is highly resistant to wear such as cast tungsten carbide, sintered carbide or a ceramic material. A problem has been encountered in securing such nozzles in place and yet allow the nozzle to be easily removed and/or replaced.

Replaceable nozzles have been developed in the past. These nozzles have been retained in a fluid discharge bore in the bit body by abutting their upper ends against shoulders in the bore and then inserting snap rings into grooves at the lower end of the nozzle or a retainer element bridging between the nozzle and the bit body. The drilling fluid is very abrasive, and the exposure of the snap ring as well as the bit body at the lower end of the nozzle adjacent the snap ring groove to the wash of the drilling fluid has caused this snap ring as well as the body portion supporting it to erode and fail, permitting the nozzle to be lost into the bottom of the hole. This structural arrangement, wherein the snap ring and its support are continually exposed to drilling fluid, together with the fact that higher drilling fluid jet velocities and consequently high pressure differentials across the nozzle are being used, combine to make the snap ring somewhat unsatisfactory in many cases for retaining nozzles in the bit body. The retaining element occasionally becomes stuck in the matching grooves and difficulty is encountered in removing the retaining element.

BRIEF DESCRIPTION OF PRIOR ART

In U.S. Pat. No. 2,855,182 to Lyle L. Payne, assigned to Hughes Tool Company, patented Oct. 7, 1958, a replaceable nozzle for drill bits is shown. The nozzle is locked in place by a snap ring which bridges between a groove in the nozzle and a groove in the bit body.

In U.S. Pat. No. 2,868,512 to Will S. Sease, assigned to Chicago Pneumatic Tool Company, patented Jan. 13, 1959, a jet nozzle protector for an earth boring drill is shown. An earth boring drill includes a bit head having a passage for the delivery of flushing fluid, a jet nozzle inserted slideably into the end of said passage, a retaining ring for the nozzle mounted in said passage below the nozzle and an annular shield mounted in said passage below the nozzle and retaining ring, said shield being arranged to line the passage wall and protect it from impingement by turbulent fluid with abrasive particles therein.

In U.S. Pat. No. 2,885,186 to Ott Hammer, assigned to Dresser Operations, Inc., patented May 5, 1959, a drill bit is shown in which drilling fluid is jetted against the bottom of the hole instead of against the cutters of the bit. The bit includes a nozzle with a suitable seal such as an O-Ring positioned in the counter bore. The nozzle is locked in place by a flange at one end of the nozzle and a snap ring at the other end of the nozzle.

In U.S. Pat. No. 3,084,751 to William E. Scarborough, assigned to Dresser Industries, Inc., patented Apr. 9, 1963, a drill bit nozzle is shown. The nozzle is releasably secured within a counter bore by means of a peripheral groove formed in the wall of the couter bore and a matching groove formed in the external wall of the nozzle forming a passageway into which a retainer member is forced to bridge across the grooves.

In British Pat. No. 763,676 to Fritz Huntsinger, et al, published Dec. 12, 1956, a drill bit with a removable orifice nozzle is shown. A rotary drill bit includes cutter means mounted on a body and a passage for discharging fluid to one side of said cutter means and against the bottom of the well bore being drilled by the drill bit. A replaceable nozzle is adapted to be moved upward into the lower portion of said passage. Seal means between said body and the nozzle prevents fluid leakage around the exterior of said nozzle. Removable retainer means engage the nozzle to hold the nozzle in the passage and to prevent downward movement of the nozzle from the passage.

SUMMARY OF THE INVENTION

The present invention provides a nozzle which may be easily installed and replaced in the field. A nozzle may thus be readily selected from among various sizes in order that a bit be readily adapted to properly utilize the hydraulic capacity of the drilling rig. The present invention provides a retaining structure for a drilling bit nozzle which is protected from the abrasive drilling fluid flowing through the bit and which is arranged to utilize the resistance to shear of a retainer member easily inserted and extracted from the external surface of the bit body. The retainer member is inserted through a first passageway in the bit body to fit within matching grooves, one of which extends around the periphery of the nozzle and the other of which extends around the inner wall of the passage. The retainer member bridges across the grooves and holds the nozzle in place. The retainer member may be forced from the grooves by forcing a drive-out element through a second passageway which extends through the bit body to the matching grooves. The above and other features and advantages of the present invention will become apparent from a consideration of the following detailed description of the invention, when taken in conjunction with the accompanying drawings.

DETAILED DESCRIPTION OF THE INVENTION

Figure 1:
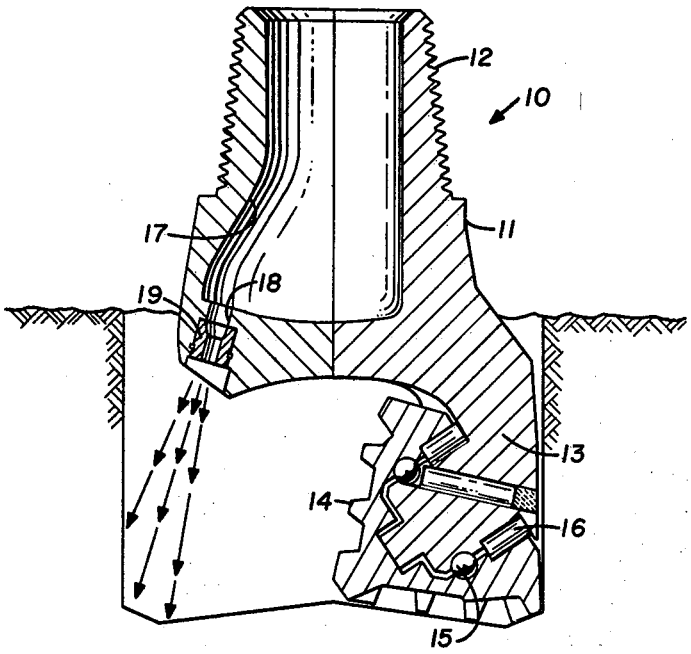
FIG. 1 is a view in vertical cross-section illustrating a rotary rock bit with a replaceable nozzle constructed in accordance with the present invention.

Referring now to the drawings and in particular to FIG. 1, a drill bit of the rolling cutter type generally designated by the reference number 10, is illustrated as comprising a body 11 having downwardly extending legs 13 upon which the rolling cutters 14 have an arrangement which is well known. Roller bearings 16 and ball bearings 15 lock the cutters 14 on the legs 13 and promote rotation thereof. The body 11 has a cavity 17 from which extend one or more passages 18 communicating between the cavity 17 and the exterior of the bit 10 for the flow of drilling fluid which emerges from the passage 18 by way of nozzle 19, made of erosion resistant material such as tungsten carbide, sintered carbide, rubber or ceramic material.

Figure 2:
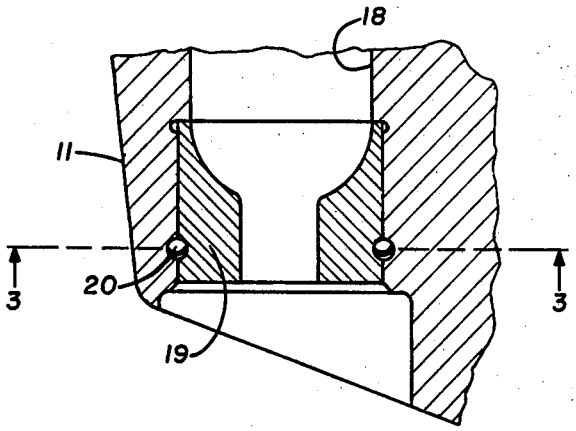
FIG. 2 is an enlarged view of the portion of the bit shown in FIG. 1 that includes the replaceable nozzle.

Nozzle 19 is shown in greater detail in FIG. 2. It is to be understood that the invention may also be utilized with other types of bits and is not limited to the rolling cutter type shown. Further, the invention comprehends the use of either a single fluid passage in the bit or plurality of passages in which nozzles are to be positioned to direct drilling fluid. Further, the invention comprehends the use of nozzles in body passages which direct the drilling fluid in jets against either the cutters or against the bottom or sides of the hole being drilled by the cutters.

Figure 3:
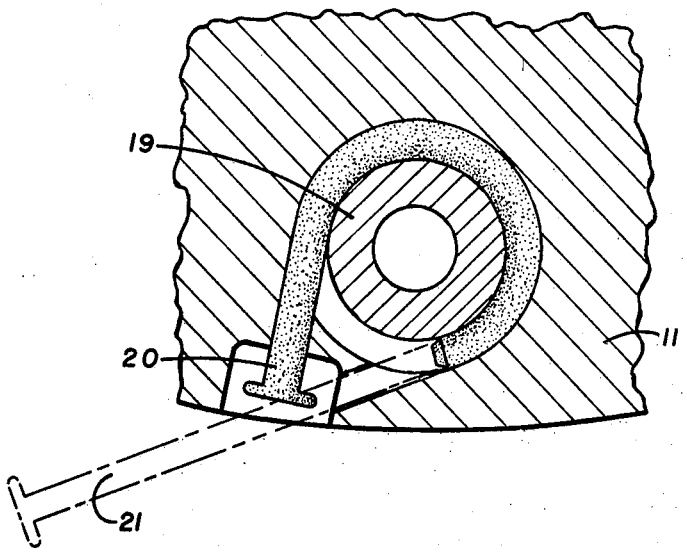
FIG. 3 is a view in horizontal cross-section taken along lines 3—3 of FIG. 2.

The passage 18 is counterbored to form a shoulder which faces downwardly and to which the upper end of the nozzle 19 is adjacent. The internal diameter of the counterbore is slightly larger than the outer diameter of the nozzle in order that the nozzle may be readily slid into the counterbore, or removed, without rotation. The nozzle 19 is releasably secured within the counterbore of passage 18 by means of a peripheral groove formed in the wall of the counterbore and a matching groove formed in the external wall of the nozzle forming a passageway into which a retainer member 20 is forced to bridge across the grooves. The axis of this passageway is circular, about the nozzle 19. Retainer member 20 being an elongated solid body, is forced along the axis of this passage and thereby deformed, or distorted, into the shape of the passage. The retainer member 20 is forced into the groove passageway from an entrance passageway through the body of the bit as shown in FIG. 3. This entrance passageway extends from the external surface of the bit body 11 and is brought into the groove passageway tangentially. The registration of these passageways in this manner enables the retainer member 20 to slide around smoothly locking the nozzle 19 into the bit body 11.

On occasion the retainer member 20 becomes locked in the groove passageway and/or entrance passageway. It must be remembered that the bit 10 operates in a borehole containing corrosive and/or adhesive materials. The materials in the borehole may enter the passageways containing the retainer member 20 and cause the retainer member 20 to become stuck. A removal passageway is provided in order to facilitate removal of the retainer member 20. A removal element 21 is provided that may be inserted through the removal passageway until it contacts the retainer member 20. The removal element 21 being an elongated solid body is deformed along the groove passageway and follows retainer member 20 and forces it from the groove passageway. The removal element 21 also allows the retainer member 20 to be removed even if the head of the retainer member is broken off.

Figure 4:
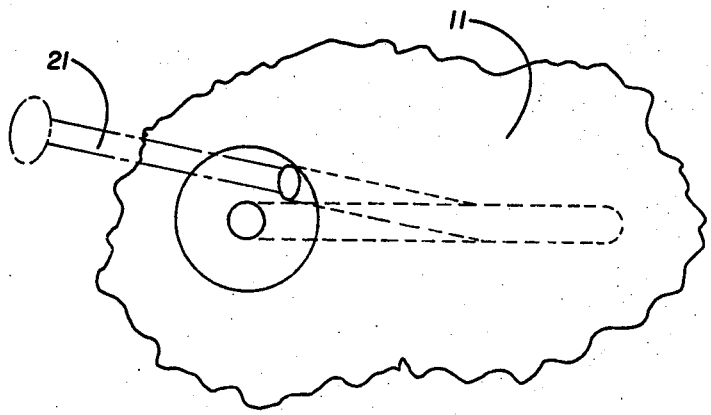
FIG. 4 is an illustration of a side view of a portion of the bit shown in the foregoing drawings in the area of the replaceable nozzle.

FIGS. 3 and 4 show the relation between the passageways most clearly. These views are taken along that portion of the bit 10 holding the nozzle 19, first in a plane common to the groove passageway and retainer member 20 and second perpendicular to the first view. A hammer will drive the retainer member 20 into locking position. In many instances a simple grasping tool, such as pliers, can be used to extract the retainer member 20 manually. In other situations the remover element 21 will be required to extract the retainer member 20.

The retainer member 20 must be made of material which can be deformed into the groove passageway but which is tough and strong enough to hold the nozzle against the forces placed on it. In position within its passageway, the body of the retainer member 20 is placed in shear along its entire length. The choice of form and material for the retainer member 20 depends upon the subjective factors of a particular design problem to which the invention is applied.

The force of the large pressure drop across the nozzle would, of course, tend to drive fluid between the outer cylindrical surface of the nozzle and the wall of the counterbore of passage 18. If the highly abrasive drilling fluid were allowed to wash down between these two surfaces it could erode the locking structure and cause its eventual failure. The present invention accordingly contemplates including a seal means between the nozzle 19 and the passage 18. The specific form of seal structure contemplated in the preferred embodiment of the invention includes an annular groove about the nozzle, in the bit body passage 18, and resilient seal body in the groove to bear against the nozzle surface to provide resistance to leakage.

The nozzle shown in the various figures of the drawing utilizes an internal configuration in which the internal diameter below the top of the nozzle is materially reduced toward the nozzle bottom. This streamlined reduction in cross-section increases the velocity of the drilling fluid greatly. However, it must be emphasized that this configuration is only representative of many variations possible. For example, it may be required that the nozzle be simply cylindrical. Whatever the configuration used internally of the nozzle, it must not be construed as limiting the scope of invention embodied in the locking combination disclosed.

The embodiments of the invention in which an exclusive property or privilege is claimed are defined as follows:

1. A method of securing and replacing a nozzle in a rotary rock bit, said rock bit having a body with cutter means mounted thereon, a fluid passage for discharging drilling fluid downwardly from the body, and a nozzle of erosion resistant material adapted to fit within said fluid passage for discharging drilling fluid, comprising the steps of:

providing a first annular groove extending around said nozzle;

providing a second annular groove in said body located in said fluid passage adapted to register with the first annular groove extending around said nozzle;

positioning said nozzle in said fluid passage with said first annular groove registering with said second annular groove, said first annular groove and said second annular groove substantially lying in a common plane;

providing a first passageway in said body which extends from the external surface of said body into register with said first and second annular grooves;

providing a second passageway in said body which extends from the external surface of said body into register with said first and second annular grooves, said second passageway being positioned at an angle to said common plane;

positioning a retainer member in one of said first and second passageways and in said first and second annular grooves until it bridges between the first and second annular grooves to form a locking structure which prevents movement of the nozzle within said fluid passage;

forcing a removal element into the other of said first and second passageways and into said first and second annular grooves until it comes into contact with said retainer member; and driving said retainer member from said first and second annular grooves and allowing said nozzle to be removed from said fluid passage.

* * * * *